United States Patent [19]

Yamamoto, deceased

[11] 4,183,221

[45] Jan. 15, 1980

[54] CRYOGENIC LIQUEFIED GAS TANK

[75] Inventor: Katsuro Yamamoto, deceased, late of Tokyo, Japan, by Michiko Yamamoto, legal representative

[73] Assignee: Bridgestone Liquefied Gas Co. Ltd., Tokyo, Japan

[21] Appl. No.: 810,677

[22] Filed: Jun. 27, 1977

[30] Foreign Application Priority Data

Jul. 2, 1976 [JP] Japan ..... 51/79334

[51] Int. Cl.[2] ..... F17C 3/02

[52] U.S. Cl. ..... 62/45; 52/249; 114/74 A; 220/901

[58] Field of Search ..... 62/45; 220/9 LG, 18, 220/901; 114/74 A; 52/239, 169.6, 169.7, 234, 249

[56] References Cited

U.S. PATENT DOCUMENTS

| | | | |
|---|---|---|---|
| 2,177,859 | 10/1939 | Brice | 52/249 |
| 2,430,519 | 11/1947 | Mallory | 220/18 |
| 2,558,580 | 6/1951 | Pomykala | 220/18 |
| 3,031,856 | 5/1962 | Wiedemann et al. | 220/901 |
| 3,034,309 | 5/1962 | Muck | 114/74 A |
| 3,092,063 | 6/1963 | Leroux | 114/74 A |
| 3,457,890 | 7/1969 | Rivas et al. | 114/74 A |
| 3,988,995 | 11/1976 | Finsterwalder | 220/901 |

FOREIGN PATENT DOCUMENTS

| | | | |
|---|---|---|---|
| 1341330 | 9/1963 | France | 62/45 |
| 1589860 | 4/1970 | France | 62/45 |
| 1184901 | 3/1967 | United Kingdom | 62/45 |
| 1248419 | 10/1971 | United Kingdom | 62/45 |
| 1272312 | 4/1972 | United Kingdom | 62/45 |
| 1422783 | 1/1976 | United Kingdom | 62/45 |

*Primary Examiner*—Ronald C. Capossela
*Attorney, Agent, or Firm*—Stevens, Davis, Miller & Mosher

[57] ABSTRACT

A cryogenic liquefied gas tank composed of a gas-tight outer vessel, a heat insulating layer provided at the inside of the outer vessel and a liquid-tight inner vessel made of concrete and provided at the inside of the heat insulating layer, wherein the hydraulic pressure of the cryogenic liquefied gases loaded in the inner vessel is supported by the concrete inner vessel while the gas pressure of the cryogenic liquefied gases is supported by the gas-tight outer vessel.

12 Claims, 6 Drawing Figures

CRYOGENIC LIQUEFIED GAS TANK

BACKGROUND OF THE INVENTION

The present invention relates to a cryogenic liquefied gas tank for containing cryogenic liquefied gases such as natural gas or other petroleum gases which are in the gaseous state at room temperature and are liquefied by refrigeration at atmospheric pressure.

The tanks for the aforementioned purpose generally have rigid outer or inner vessels of a standing cylindrical shape which support the hydraulic pressure of the load of cryogenic liquefied gases contained therein. In accordance with the requirement for a larger capacity of the tanks in these years, the cylindrical tanks have gradually increased in diameter and height but they are now approaching the limit in view of the strength of the side wall and the roof and the difficulties encountered in construction techniques. Furthermore the construction of very large tanks brings about a safety problem.

At present, therefore, a large-scale storage area has a number of tanks placed with spaces between them, each being constructed to have as large a capacity as possible. However, when the tanks are placed adjacent to one another, the regulations generally require a relatively large space to be left between the tanks in view of ensuring safety in emergency, and, consequently, an extensive land area is required for the storage area, thereby substantially increasing its cost and reducing its economic merit.

SUMMARY OF THE INVENTION

It is therefore the object of the present invention to solve the aforementioned problems with regard to conventional cryogenic liquefied gas tanks and to provide a novel cryogenic liquefied gas tank which can be constructed on a much larger scale without causing problems with regard to strength and cost of construction thereby saving land cost and lowering the overall construction cost of the storage area.

In accordance with the present invention, the abovementioned object is accomplished by providing a cryogenic liquefied gas tank comprising a gas-tight outer vessel, a heat insulating layer provided at the inside of said outer vessel and a liquid-tight inner vessel made of concrete and provided at the inside of said heat insulating layer, said inner vessel receiving a load of cryogenic liquefied gases and supporting the hydraulic pressure of said load while said outer vessel supports the gas pressure of said load.

In the abovementioned structure of the tank, the inner vessel supporting the hydraulic pressure of the load of cryogenic liquefied gases can be reinforced by reinforcing rims provided at the inside and/or outside thereof or by internal partitions. Or alternatively the outer vessel may contain a plurality of independent inner vessels. The outer vessel need only support the gas pressure of the load of cryogenic liquefied gases. Therefore, the capacity of the tank of the present invention can be increased as required by increasing the strength of the inner vessel. The inner vessel need not be gas-tight and may be made of concrete and can be constructed at relatively low cost. When the inner vessel becomes very large the inner space thereof may be divided by internal partitions or the tank may be made of an assembly of a plurality of smaller tanks. In this manner, a tank of large capacity can be constructed while ensuring a high safety against deformation or shifting of the ground due to freezing, sinking, or earthquake.

With respect to the strength of the outer vessel, it is easy to ensure a sufficient strength for the side wall and the bottom against the gas pressure, while difficulty is only encountered in securing sufficient strength for the roof against the upward force applied by the internal gas pressure, particularly when the diameter of the tank becomes very large.

In view of the abovementioned problem, it is another object of the present invention to provide a cryogenic liquefied gas tank of the abovementioned structure, wherein at least a part of the upward force acting on the roof of the outer vessel is taken by a pillar mounted to the inner vessel or the base of the tank.

The upward force acting on the roof of the outer vessel may also be balanced by a weight mounted on the roof of the outer vessel. In this case, however, there is a danger that the weighted roof of the outer vessel cannot be supported by the side wall at the peripheral portion thereof when the internal gas pressure has lowered or disappeared or when an additional external load such as snow has been applied.

In view of the abovementioned problem, it is still another object of the present invention to provide a cryogenic liquefied gas tank of the abovementioned structure, wherein at least a part of the weight of the roof portion of the outer vessel is opposed by the upward force acting on the roof portion while at least a part of the weight of the roof portion of the outer vessel is supported by a pillar mounted to the inner vessel or the base of the tank.

Since a pillar can be provided at the inside of the outer vessel in accordance with the tank structure of the present invention, the roof portion of the outer vessel is readily reinforced, whereby the present invention enables us to construct any large tank.

Since the inner vessel and the pillar contract when the inner vessel is charged with cryogenic liquefied gases, it is desirable that the roof portion of the outer vessel is constructed to be shiftable up and down with respect to the side wall portion thereof. Therefore, it is desirable that the outer vessel is constructed by two separate portions, one being a main portion providing the bottom portion and the side wall portion while the other being the roof portion which is shiftable with respect to the main portion.

It is desirable for reasons of strength that the inner vessel is divided by internal partitions. In this case, it is desirable that a through opening is provided at a lower portion of the individual internal partitions so that only one set of gas supply means such as a gas supply pipe, pump, etc. need be provided for all of the divided chamber spaces. Similarly, it is desirable that a gas through opening is provided at an upper part of the individual internal partitions for balancing the gas pressure among individual divided chamber spaces.

The outer vessel may be made of steel plate or concrete. However, when the outer vessel is made of concrete, it is required that a seal layer of metal or plastic is provided at the inside of the outer vessel to ensure the gas-tightness of the outer vessel. Since the seal layer is provided at the outside of the heat insulating layer, it need not be made of a cold-resistant material. However, it is required that the seal plate envelope structure include a flexible portion incorporated in the joining portion between the roof portion and the side wall portion so as to allow for the shifting movement of the roof portion with respect to the side wall portion of the outer vessel.

The bottom portion of the heat insulating layer is subject to the weight of the inner vessel, the weight of the roof portion of the outer vessel, and the hydraulic and gas pressure of the load of cryogenic liquefied gases. Therefore, the bottom portion of the heat insulating layer must be a compression resistant layer made of a compression resistant heat insulating material or a composite layer including a load supporting frame structure. When the weight of the roof portion of the outer vessel is supported directly from the base of the outer vessel, the bottom portion of the heat insulating layer will be relieved from the load corresponding to the weight of the roof portion of the outer vessel. Since the side wall portion of the heat insulating layer is not applied any load by the cryogenic liquefied gases contained in the inner vessel, it need not be compression resistant and may be made of non-compression resistant heat insulating material such as pearlite or the like at a relatively low cost of material and construction.

It is desirable that the roof portion of the heat insulating layer is made of a compression resistant heat insulating material or is constructed as a composite structure including a load supporting frame so that the heat insulating layer is capable of supporting a part of the weight of the roof portion of the outer vessel.

According to a particular feature of the present invention, the bottom portion and at least a lower side wall portion of the heat insulating layer is constructed to be liquid-tight and to be capable of supporting a load of cryogenic liquefied gases. By incorporating this structure in the tank, even if a leakage of cryogenic liquefied gases has happened in the inner vessel, the abovementioned lower structure of the heat insulating layer provides a secondary barrier wall which contains the leaked-out cryogenic liquefied gases therein and protects the outer vessel from being subjected to the cryogenic temperature. Therefore, the reliability of the tank is further improved.

BRIEF DESCRIPTION OF THE DRAWING

The present invention will become more fully understood from the detailed description given herein below and the accompanying drawings which are given by way of illustration only and are thus not limitative of the present invention and wherein.

DESCRIPTION OF THE PREFERRED EMBODIMENTS

Figure 1:
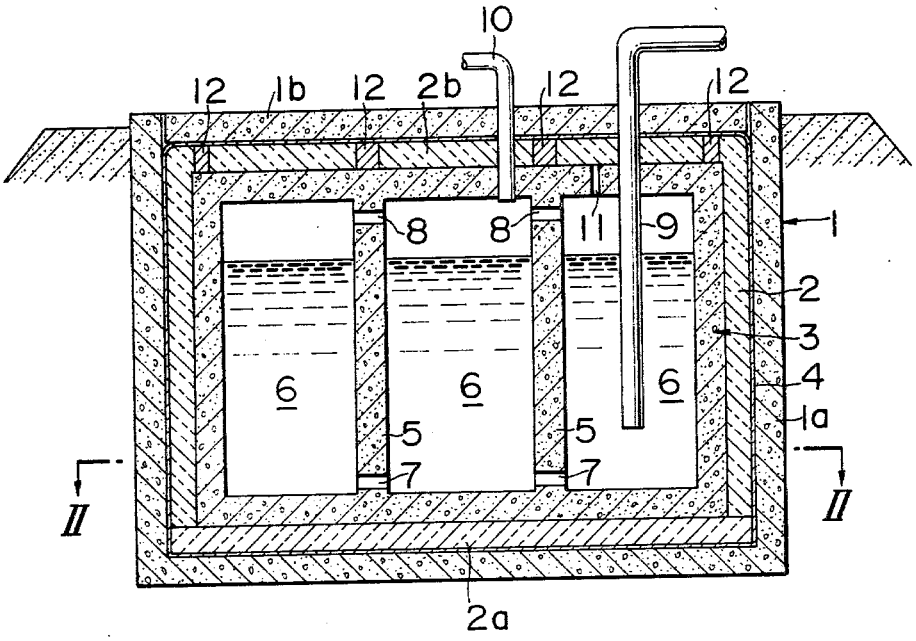
FIG. 1 is a diagrammatic vertical sectional view of an embodiment of the cryogenic liquefied gas tank of the present invention.
Figure 2:
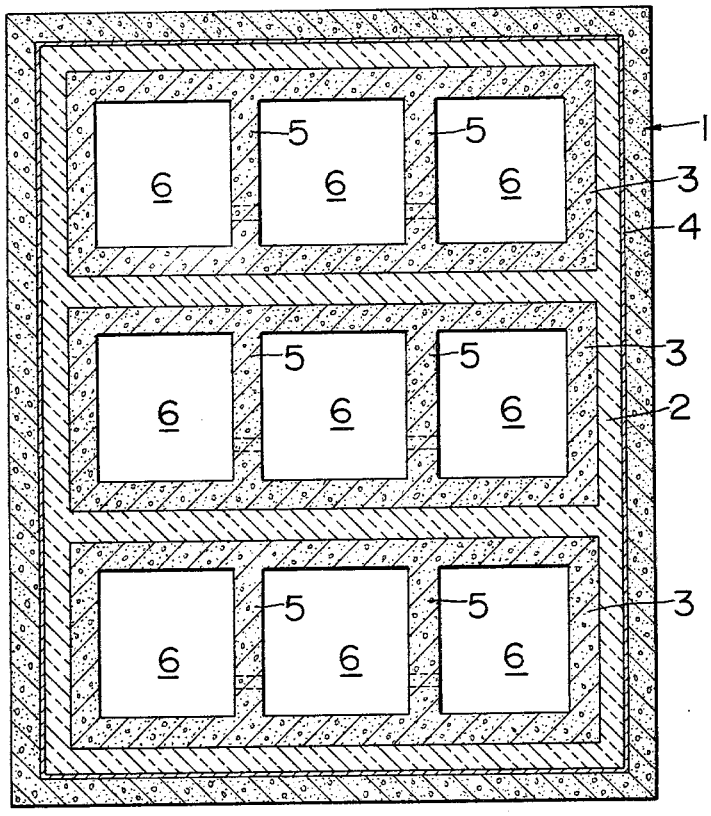
FIG. 2 is a sectional plan view along the line II—II in FIG. 1.

Referring to FIGS. 1 and 2, 1 designates an outer vessel of the tank, at the inside of which is provided a heat insulating layer 2. Further, at the inside of the heat insulating layer is provided an inner vessel 3. In the shown embodiment, the outer vessel 1 is made of concrete and is constructed as an assembly of a main body 1*a* of a box shape having side wall portions and a bottom portion and opened at the top thereof, and a roof body 1*b* which closes the open top portion of the main body 1*a*. The outer vessel 1 is provided with a seal plate 4 made of metal, plastic, or the like lining the inside surface of the outer vessel so as to provide a gas-tight structure of the outer vessel. The outer vessel 1 need only be capable of supporting the gas pressure of the gases which have penetrated the concrete wall of the inner vessel 3 and have also passed through an upper through opening 11 explained hereinunder, said gases being generated from the cryogenic liquefied gases charged in the inner vessel. In order to increase the strength of the outer vessel, it may be reinforced by earth piled therearound as shown in FIG. 1. The bottom heat insulating layer 2*a* supporting the inner vessel 3 must be compression resistant and may preferably be made of pearlite concrete. The other portions of the heat insulating layer such as the side wall portion and the roof portion are not subject to any hydraulic pressure of the cryogenic liquefied gases contained in the inner vessel and, accordingly, they need not be compression resistant, and may be made of any soft heat insulating material, such as pearlite, polyurethane foam, or the like. The roof heat insulating layer 2*b* may preferably be made of a compression resistant heat insulating material so as to support the roof body 1*b* of the outer vessel.

In the shown embodiment, the internal space of the inner vessel 3 is divided into three chambers 6 by two internal partitions 5. The partitions 5 are provided with liquid balancing openings 7 at a lower portion thereof and gas balancing openings 8 at an upper portion thereof. By these openings the gas pressure and the hydraulic pressure in the individual chambers are balanced. A liquid pipe 9 is introduced into one of the chambers 6 for supplying cryogenic liquefied gases into the inner vessel 3, while a gas pipe 10 is introduced into another chamber 6 for taking out gases from the inner vessel. In order to balance the gas pressures existing in the inner vessel and in the space of the heat insulating layer 2, the inner vessel is provided with a gas balancing opening 11. In the shown embodiment, three inner vessels such as the one shown in FIG. 1 are housed in the outer vessel 1 as shown in FIG. 2. Although the heat insulating layer is provided between the two adjacent inner vessels, these intermediate heat insulating layers are not indispensable.

Figure 3:
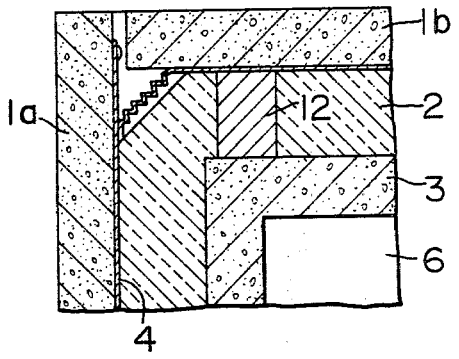
FIG. 3 is an enlarged sectional view showing a detailed structure of a roof corner portion in the tank structure shown in FIG. 1.

In the shown embodiment, the roof body 1*b* of the outer vessel is supported by the inner vessel 3 by way of a plurality of pillar members 12 placed in alignment with the side walls and the internal partitions 5 of the inner vessel. Therefore, the roof body 1*b* is vertically shiftable with respect to the main body 1*a* of the outer vessel. In this connection, as shown in FIG. 3, the seal plate 4 incorporates a flexible structure such as a bellows structure at a joining portion of the roof portion and the side wall portion thereof so as to allow for the vertical shifting of the roof body 1*b*.

Figure 4:
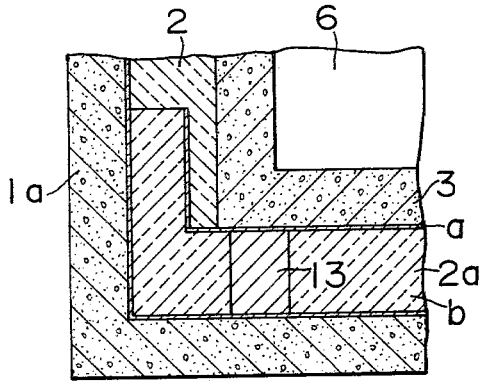
FIG. 4 is an enlarged sectional view showing a detailed structure of a bottom corner portion to be incorporated in the tank structure shown in FIG. 1.

As shown in FIG. 4, the bottom portion and the lower side portion of the heat insulating layer 2 may comprise a liquid-tight panel structure a and a compression resistant heat insulating material b. This bottom and lower side structure a, b incorporated in the heat insulating layer 2 operates as a secondary barrier wall when a liquefied gas leakage has occurred in the inner vessel. A pillar member 13 may be provided in the bottom portion of the heat insulating layer in order firmly to support the inner vessel 3.

Figure 5:
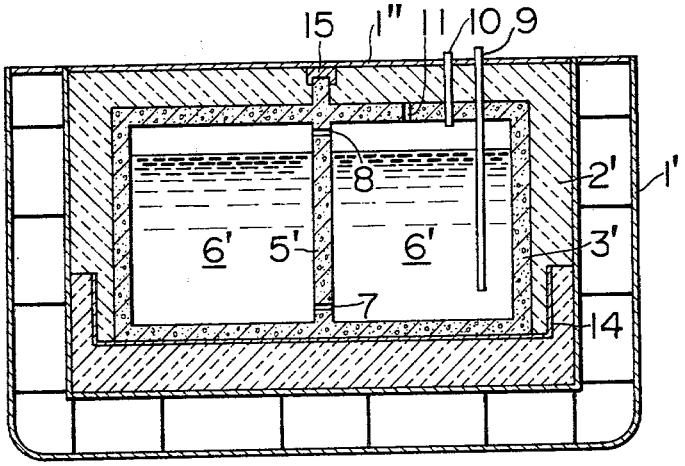
FIG. 5 is a diagrammatic sectional view of an embodiment of the cryogenic liquefied gas tank of the present invention which is embodied as a cryogenic liquefied gas tanker.

FIG. 5 shows another embodiment of the present invention incorporated in a cryogenic liquefied gas tanker. In this case, the outer vessel is provided by an inner shell 1' of a dual walled shell of the tanker. At the inside of the inner shell is provided a heat insulating layer 2', and further at the inside of the heat insulating layer is provided an inner vessel 3' made of concrete and divided into a plurality of chambers 6' by an internal partition 5'. The inner vessel is engaged with the deck 1'' at a roof portion thereof by a key structure 15. The inner vessel 3' is also provided with the liquid balancing opening 7, gas balancing openings 8 and 11, the liquid pipe 9 and the gas pipe 10 in the same manner as in the embodiment shown in FIG. 1. Furthermore, this embodiment incorporates a secondary barrier wall 14 made of a seal plate in the bottom and lower side wall portion thereof.

Figure 6:
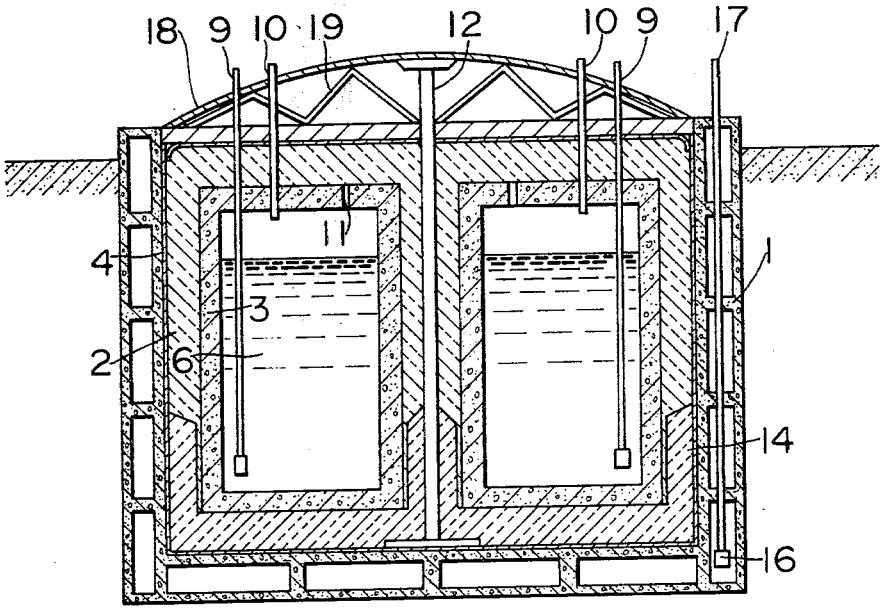
FIG. 6 is a diagrammatic vertical sectional view of an embodiment of the cryogenic liquefied gas tank of the present invention which is embodied as an underground tank.

FIG. 6 shows still another embodiment of the present invention embodied as an underground cryogenic liquefied gas tank. In FIG. 6, the portions corresponding to those shown in FIGS. 1 and 2 are designated by the same reference numerals and the detailed explanations for these portions will be omitted for the purpose of simplicity. The tank shown in FIG. 6 further comprises a drain pump 16 and a drain pipe 17. The roof portion of the outer vessel is formed as a dome 18 reinforced by a frame structure 19. It will be understood that the tank shown in FIG. 6 has substantially the same structure as the tanks shown in FIG. 1 and FIG. 5 and operates in the same manner.

Although the invention has been shown and described with respect to some preferred embodiments thereof, it should be understood by those skilled in the art that various changes and omissions of the form and detail thereof may be made therein without departing from the scope of the invention.

It is claimed:

1. A cryogenic liquefied gas tank comprising a gas-tight outer vessel, a heat insulating layer provided at the inside of said outer vessel, and a plurality of liquid-tight inner vessels each being made of concrete and provided at the inside of said heat insulating layer, said inner vessels each receiving a load of cryogenic liquefied gases and supporting the hydraulic pressure of said load while said outer vessel supports the gas pressure of said load.

2. The tank of claim 1, wherein said inner vessel comprises an internal partition or partitions which divide the internal space of the inner vessel into a plurality of chambers.

3. The tank of claim 1, wherein said outer vessel is composed of a main body providing the bottom and the side wall portions of the outer vessel and a roof body.

4. The tank of claim 3, wherein said roof body is vertically supported from said inner vessels and is vertically shiftable with respect to said main body.

5. The tank of claim 4, further comprising pillar members provided between said roof body and said inner vessels so as to support said roof body against said inner vessel.

6. The tank of claim 3, further comprising a pillar member which supports said roof body from said main body.

7. The tank of claim 2, wherein said internal partition is formed with a liquid balancing opening at a lower portion thereof and a gas balancing opening at an upper portion thereof.

8. The tank of claim 1, wherein said inner vessel is formed with a gas balancing opening for balancing gas pressures existing at the inside and outside of said inner vessel.

9. The tank of claim 1, wherein said outer vessel is made of concrete and comprises a seal plate lining the inside surface thereof.

10. The tank of claim 9, wherein said outer vessel comprises a main body providing the bottom and the side wall portions of said outer vessel and a roof body while said seal plate comprises a flexible joint at joining portions between a roof portion and side wall portions thereof.

11. The tank of claim 1, further comprising a secondary barrier wall structure incorporated in a bottom and lower side wall portions of said heat insulating layer.

12. The tank of claim 11, wherein said secondary barrier wall structure comprises a seal plate having a bottom portion and side wall portions and a compression resistant heat insulating layer supporting said bottom portion and side wall portions of said seal plate.

* * * * *